US011603731B2

(12) United States Patent
Yendell et al.

(10) Patent No.: US 11,603,731 B2
(45) Date of Patent: Mar. 14, 2023

(54) INSERTS FOR VARIABLE BORE RAMS

(71) Applicant: Baker Hughes Oilfield Operations LLC, Houston, TX (US)

(72) Inventors: Elliot T. Yendell, Houston, TX (US); Rick L. Stringfellow, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 17/024,272

(22) Filed: Sep. 17, 2020

(65) Prior Publication Data

US 2022/0081987 A1 Mar. 17, 2022

(51) Int. Cl.
*E21B 33/06* (2006.01)
*E21B 33/064* (2006.01)

(52) U.S. Cl.
CPC ..... *E21B 33/063* (2013.01); *E21B 33/064* (2013.01)

(58) Field of Classification Search
None
See application file for complete search history.

(56) References Cited

U.S. PATENT DOCUMENTS 3,915,242 A * 10/1975 Bell ..... B25C 1/14 173/206
4,444,404 A * 4/1984 Parks, Jr. ..... E21B 33/062 251/1.2
5,361,832 A 11/1994 Van Winkle
6,367,804 B1 * 4/2002 Watts ..... E21B 33/062 251/1.2
6,857,634 B2 * 2/2005 Araujo ..... E21B 33/062 277/325
8,978,751 B2 * 3/2015 Castriotta ..... E21B 33/062 166/85.4
9,580,988 B2 * 2/2017 Bleck ..... E21B 33/061
10,233,715 B2 * 3/2019 Zonoz ..... E21B 33/06
10,287,841 B2 5/2019 Zonoz et al.
2012/0227987 A1 9/2012 Castriotta
2016/0160599 A1 * 6/2016 Bleck ..... E21B 33/062 277/325
2018/0023361 A1 1/2018 Zonoz

FOREIGN PATENT DOCUMENTS

CN 204663460 9/2015
WO 2017/039951 3/2017

OTHER PUBLICATIONS

West Engineering Services, "High Temperature Elastomer Study for MMS," dated Jun. 2, 2009, pp. 1-27.
International Search Report and Written Opinion dated Dec. 20, 2021 in corresponding PCT Application No. PCT/US2021/071422.

* cited by examiner

*Primary Examiner* — Matthew Troutman
*Assistant Examiner* — Douglas S Wood
(74) *Attorney, Agent, or Firm* — Hogan Lovells US LLP

(57) ABSTRACT

A blowout preventer (BOP) assembly includes a body portion, a bore extending through the body portion, and a ram block assembly. The ram block assembly includes a first ram block being movable into the bore and a second ram block being movable into the bore. The ram block assembly also includes inserts arranged within each of the first ram block and second ram block, the inserts being movable to change a sealing diameter of the ram block assembly, wherein each insert includes a plurality of lips extending into voids formed between adjacent inserts, respective lips being positioned along intersecting regions of adjacent inserts

5 Claims, 8 Drawing Sheets

INSERTS FOR VARIABLE BORE RAMS

BACKGROUND

1. Field of Disclosure

This disclosure relates in general to oil and gas tools, and in particular, to rams used for blowout preventers (BOPs) in oil and gas wells.

2. Description of the Prior Art

Blowout preventers (BOPs) are typically used in surface and subsea drilling operations to protect an oil well from pressure surges. Generally, BOPs include a series of rams aligned with a central bore. A drill pipe extends through the central bore and into the well below the BOP. Each set of rams is typically positioned with one ram on either side of the central bore. Some rams are designed to seal against the drill string when closed, but not to cut the drill string. Other rams include blades, and are designed to shear the drill string (and anything else in the central bore) when the rams are closed to completely seal the top of the well.

A typical BOP includes a bore that runs through the BOP and connects to a wellbore. Pipe and tools are introduced to the wellbore through the bore in the BOP. Generally, a variable bore ram includes inserts that enable an inner diameter of the ram to change in response to different diameters of pipe extending through the bore. The rams also include a packing material, such as an elastomer, to facilitate sealing against the pipe. This elastomer material may be particularly selected based on expected operating conditions, and as a result, the rams may have limited operational functionality

SUMMARY

Applicant recognized the problems noted above herein and conceived and developed embodiments of systems and methods, according to the present disclosure, for variable bore rams.

In an embodiment, a blowout preventer (BOP) assembly includes a body portion, a bore extending through the body portion, and a ram block assembly. The ram block assembly includes a first ram block being movable into the bore and a second ram block being movable into the bore. The ram block assembly also includes inserts arranged within each of the first ram block and second ram block, the inserts being movable to change a sealing diameter of the ram block assembly, wherein each insert includes a plurality of lips extending into voids formed between adjacent inserts, respective lips being positioned along intersecting regions of adjacent inserts.

In an embodiment, an insert for a variable bore ram block includes a top portion. The top portion includes an upper overlapping portion having a first lip extending in an axially downward direction, an upper overlapped portion having a second lip extending in the axially downward direction, and a first step between the upper overlapping portion and the upper overlapped portion, the step having a first axial height change between the upper overlapping portion and the upper overlapped portion. The insert also includes a bottom portion. The bottom portion includes a lower overlapping portion having a third lip extending in an axially upward direction, a lower overlapped portion having a fourth lip extending in the axially upward direction, and a second step between the lower overlapping portion and the lower overlapped portion, the second step having a second axial height change between the lower overlapping portion and the lower overlapped portion. The insert also includes a body portion between the top portion and the bottom portion, the body portion connecting the top portion to the bottom portion.

In an embodiment, a ram block assembly includes a first ram block, a second ram block, and a first sealing assembly, coupled to the first ram block. The first sealing assembly includes a first body, a first packer installed within a first cavity of the first body, and a first plurality of inserts arranged within the first body, the first plurality of inserts being movable to change a first sealing diameter of the first ram block, wherein each insert of the first plurality of inserts includes a first plurality of lips extending into first voids formed in the first cavity, the first plurality of lips blocking a first extrusion path for the first packer. The ram block assembly also includes a second sealing assembly, coupled to the second ram block. The second sealing assembly includes a second body, a second packer installed within a second cavity of the second body, and a second plurality of inserts arranged within the second body, the second plurality of inserts being movable to change a second sealing diameter of the second ram block, wherein each insert of the second plurality of inserts includes a second plurality of lips extending into second voids formed in the second cavity, the second plurality of lips blocking a second extrusion path for the second packer.

BRIEF DESCRIPTION OF THE DRAWINGS

The present technology will be better understood on reading the following detailed description of non-limiting embodiments thereof, and on examining the accompanying drawings, in which.

DETAILED DESCRIPTION

Figure 1:
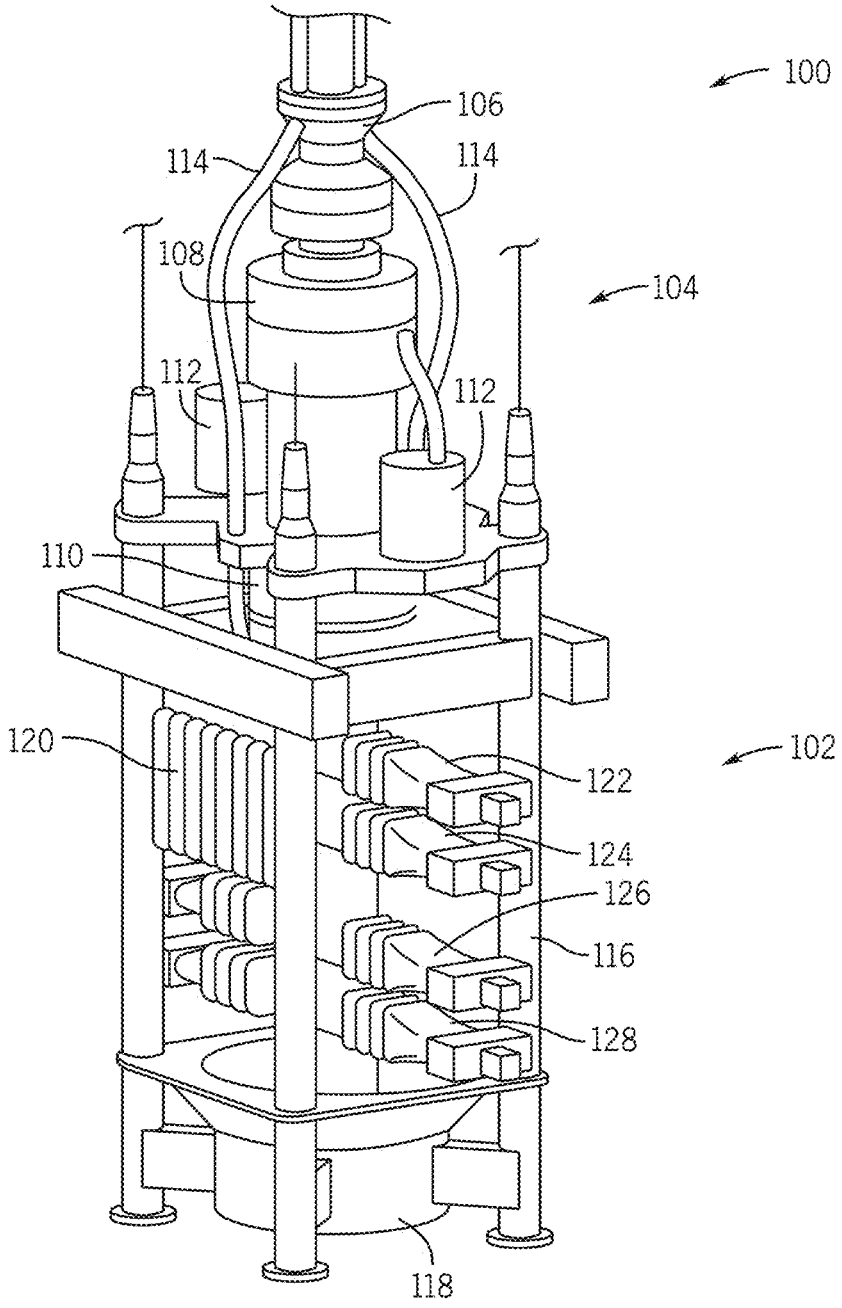
FIG. 1 is a perspective view of a BOP stack assembly attached to a wellhead, in accordance with embodiments of the present disclosure.

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The present technology, however, is not intended to be limited to the specific terms used, and it is to be understood that each specific term includes equivalents that operate in a similar manner to accomplish a similar purpose.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments," or "other embodiments" of the present disclosure are not intended to be interpreted as excluding the existence of additional embodiments that also incorporate the recited features. Furthermore, reference to terms such as "above," "below," "upper", "lower", "side", "front," "back," or other terms regarding orientation are made with reference to the illustrated embodiments and are not intended to be limiting or exclude other orientations. Moreover, like reference numerals may be used for like items throughout the specification, however, such usage is for convenience and is not intended to limit the scope of the present disclosure.

Embodiments of the present disclosure include inserts that are may be used in variable bore rams. These inserts enable a sealing diameter of the ram to change to accommodate a variety of different pipe diameters throughout the working life of a ram block assembly. In various embodiments, the inserts include one or more flow blocking features, which may be referred to as lips or the like, that block or otherwise distort an extrusion path for a packer utilized with the ram. For example, the packer may be formed from an elastomer material, among other options, that may extrude or otherwise flow when subjected to certain pressures and/or temperatures. Excess extrusion or flow may damage the ram block assembly, which may lead to sealing problems, thereby rendering the ram block assembly unsuitable for its intended purposes and may lead to repairs or replacements. Embodiment may include particularly selected lips that have particularly selected dimensions to block certain flow paths for the elastomer, thereby containing the elastomer and increasing the useful life of the ram block assembly. In certain embodiments, the inserts may be metallic inserts, at least in part, that are formed using an additive manufacturing process, among other such options. When additive manufacturing is used, a variety of different geometries may be developed that would otherwise be unsuitable using other manufacturing methods. Furthermore, designs may be readily changed without expensive tooling costs. Embodiments may improve the useful life of ram block assemblies and overcome existing problems associated with elastomer flow. As a result, ram block assemblies may be used over wide temperature and/or pressures changes.

FIG. 1, there is shown a typical subsea BOP assembly 100, including a lower stack assembly 102, and an upper stack assembly 104, or lower marine riser package (LMRP). The upper stack assembly 104 may include, for example, a riser adapter 106, annular blowout preventers 108, 110, control pods 112, and choke and kill lines 114. The lower stack assembly 102 may include a frame 116 with a wellhead connector 118 at the lower end for connecting to a subsea wellhead assembly (not shown), as well as hydraulic accumulators 120. Typically, a bore runs through the BOP assembly, including through the upper and lower stack assemblies 102, 104. The bore may contain a pipe, such as an elongated tubular. A shear ram housing 122 is normally located above pipe ram housings 124, 126, 128 on the lower stack assembly. The shear ram housing 122 contains upper and lower ram shear blocks attached to upper and lower blades. Each pipe ram housing 124, 126, 128 includes pipe ram blocks with recesses (e.g., semi-circular recesses) on the mating faces for closing around different size ranges of pipe. It should be appreciated that one or more of the pipe ram housings 124, 126, 128 may include a variable bore ram that facilitates closing around pipes having different diameters. When open the shear and pipe ram blocks are positioned on either side of the bore. When closed, the shear ram blades seal off the bore. If pipe is present in the bore, the shear ram blades will shear the pipe.

Figure 2B:
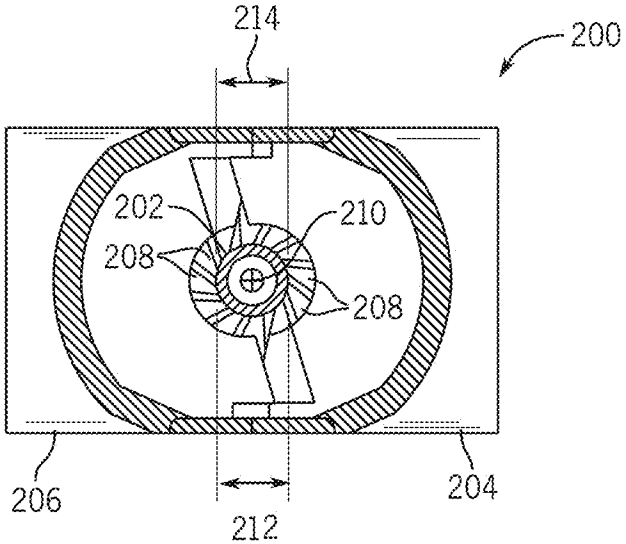
FIGS. 2A and 2B are top plan views of an embodiment of a ram block assembly, in accordance with embodiments of the present disclosure.
Figure 2A:
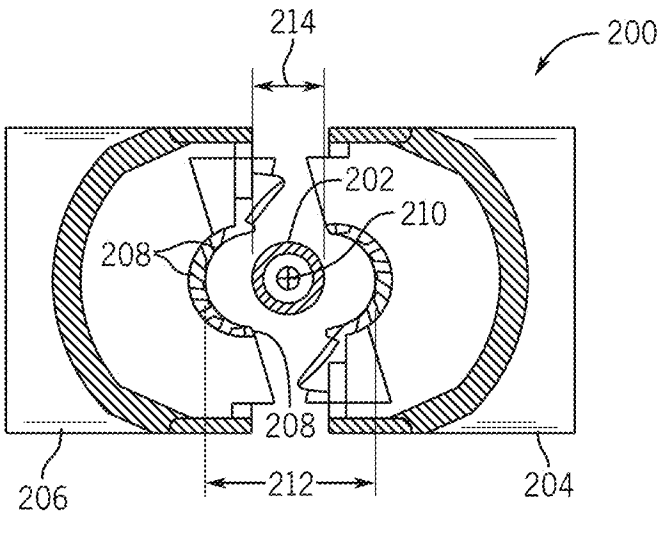

FIGS. 2A and 2B are top plan views of embodiments of a ram block assembly 200. FIG. 2A illustrates the ram block assembly 200 in an open position with a tubular 202 positioned between opposing rams 204, 206. As noted above, the ram block assembly 200 may be part of the BOP and configured to seal around the tubular 202, but not puncture the tubular 202. The illustrated rams 204, 206 each include inserts 208 (which may be part of a detachable sealing assembly) that extend radially inwardly toward an axis 210 of the bore. As will be shown, the rams 204, 206 may be radially movable to increase or decrease a sealing diameter 212 of the ram block assembly 200.

FIG. 2B illustrates the rams 204, 206 in a closed position such that the inserts 208 are sealing around an outer diameter 214 of the tubular 202. In other words, the sealing diameter 212 has changed to be approximately equal to the outer diameter 214 of the tubular 202. For example, the inserts 208 may be driven radially inward to adjust the sealing diameter 212, as shown by the relative position of the rams 204, 206 when compared to FIG. 2A. While not illustrated in FIGS. 2A and 2B, a packer may be arranged within the rams 204, 206 to drive movement of the inserts 208 and/or to facilitate sealing around the tubular 202.

In various instances, traditional variable ram blocks may incorporate packing that is particularly selected for certain applications. For example, the packers may be selected based on anticipated pressure and/or temperature conditions. As a result, certain packers may be selected for high temperature applications while others are for low temperature applications. It should be appreciated that "high" and "low" temperature applications may vary by manufacturer. In certain embodiments, an operational range may be between approximately 48 and 350 degrees Fahrenheit. A low temperature application may be between approximately 30 and 220 degrees Fahrenheit. A high temperature application may be above approximately 350 degrees Fahrenheit. Different packers may be functional at different temperature ranges, for example, due to elastomer flow during closing. Embodiments of the present disclosure are directed toward improved inserts that reduce or eliminate elastomer flow beyond a specified region, thereby enabling improved operation.

Figure 3:
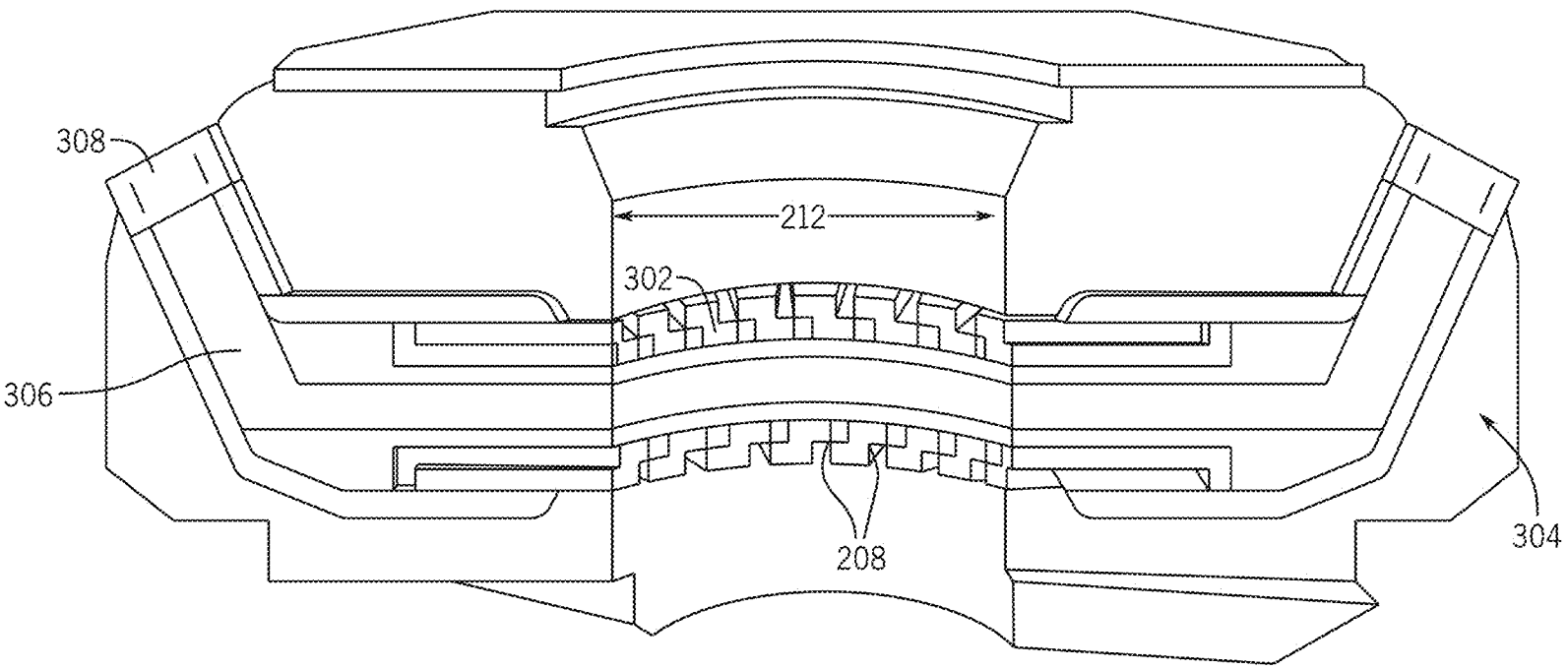
FIG. 3 is a side view of an embodiment of a ram block, in accordance with embodiments of the present disclosure.

FIG. 3 is a side-elevational view of an embodiment of a ram 300, such as the rams 204, 206. The illustrated ram 300 is a variable bore ram and includes the inserts 208. As shown, the inserts 208 are arranged in a partially overlapping manner, as will be described in detail below. In the illustrated embodiment, the inserts 208 include a face 302 that extends at least partially beyond the illustrating sealing diameter 212 of the ram 300, which in FIG. 3 corresponds to a bore formed in the ram 300. As described above, the sealing diameter 212 is variable and may be adjusted based on a position of the inserts 208, and as a result, the sealing diameter 212 may correspond to the bore and/or a diameter smaller than the bore formed by the inserts 208. The illustrated ram 300 includes a plurality of inserts 208. It should be appreciated that any number of inserts 208 may be used, as various dimensions may be particularly selected based on anticipated operating conditions. As a result, different dimensions may be optimized for stress characteristics, among other factors, and therefore certain rams may include more or fewer inserts 208. In response to operation of the BOP, the inserts 208 may be driven radially inward to contact a tubular installed through the BOP bore.

The ram 300 includes a cavity 304 that receives a packer 306, which in this embodiment is an elastomer. The packer 306 extends throughout the cavity 304 and contacts the inserts 208, which in various embodiments form at least a portion of the cavity 304. Moreover, a top seal 308 is positioned to block extrusion or flow of the packer 306 out of the cavity. During operation, the packer 306 seals against the tubular in response to movement of the inserts 208. However, as described above, certain operating conditions, such as temperature, may affect performance of the packer 306. As a result, a useful life of the packer 306 is decreased. One problem may be flow of the packer 306, where the packer 306 flows out and beyond the inserts 208. This not only reduces the useful life of the ram 300, but also may negatively affect sealing. Embodiments of the present disclosure are directed toward inserts 208 to reduce flow of the packer 306.

Figure 4:
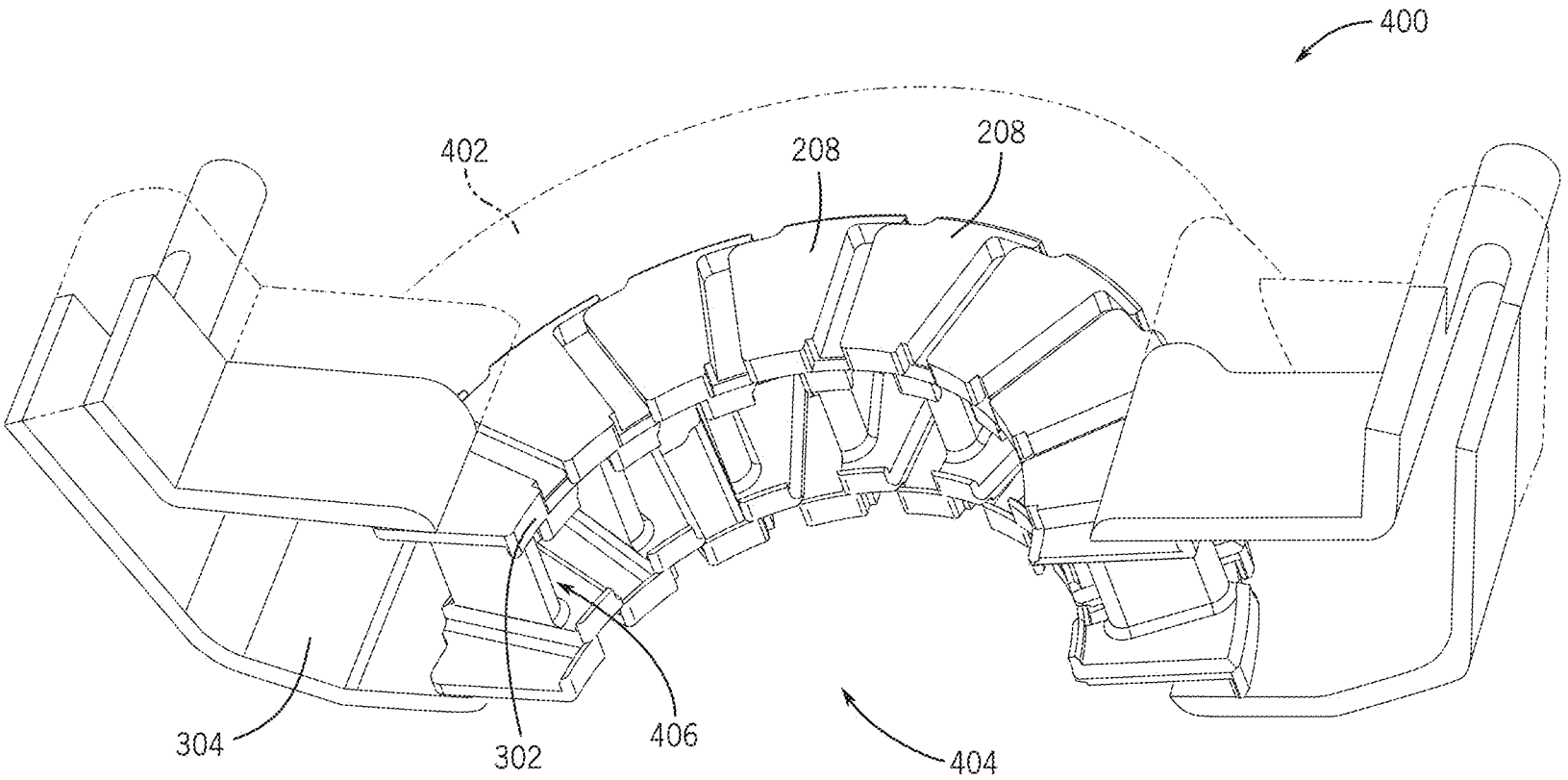
FIG. 4 is a top perspective view of an embodiment of a sealing assembly, in accordance with embodiments of the present disclosure.

FIG. 4 is a perspective view of an embodiment of a sealing assembly 400 that may be installed on a ram block. It should be appreciated that features have been removed for clarity with the following discussion. By way of example, the packer 306, which may be an elastomer as noted above, has been removed from the cavity 304. The illustrated embodiment includes the inserts 208 arranged circumferentially about a body 402 of the sealing assembly 400 to surround a center opening 404. It should be appreciated that a covering (not pictured) may also be included to specify the maximum sealing diameter 212 for the sealing assembly 400. However, in other embodiments, a ram block body may include the cover to specify the maximum sealing diameter 212.

In the illustrated embodiment, the inserts 208 are arranged in an overlapping fashion such that an arm or extension of one insert 208 may overlap an adjacent insert 208, for example at a top, but may be under a second lower extension of the same adjacent insert 208, as will be described in more detail below. Furthermore, each of the inserts 208 may include one or more lips or ridges to block movement or flow of the packer 306. For example, the lips may be arranged proximate the faces 302 to block radially inward flow of the packer 306. Furthermore, in various embodiments, the lips may be arranged at mating edges between adjacent inserts 208 to block circumferential and/or lateral flow of the packer 306.

In various embodiments, as will be described below, the lips may extend into voids 406 formed between adjacent inserts 208. During operation, the voids 406 may provide a flow path for the elastomer. By restricting or otherwise blocking at least a portion of this flow path, extrusion of the packer 306 may be reduced. Various features described below may be incorporated to reduce the flow path, such as ridges or spines, the lips, various bevels and elevation changes, and the like. Accordingly, the useful life may be increased due to reduced packer extrusion. Furthermore, packers may be used in a variety of temperature ranges because of the reduced extrusion.

Figure 5:
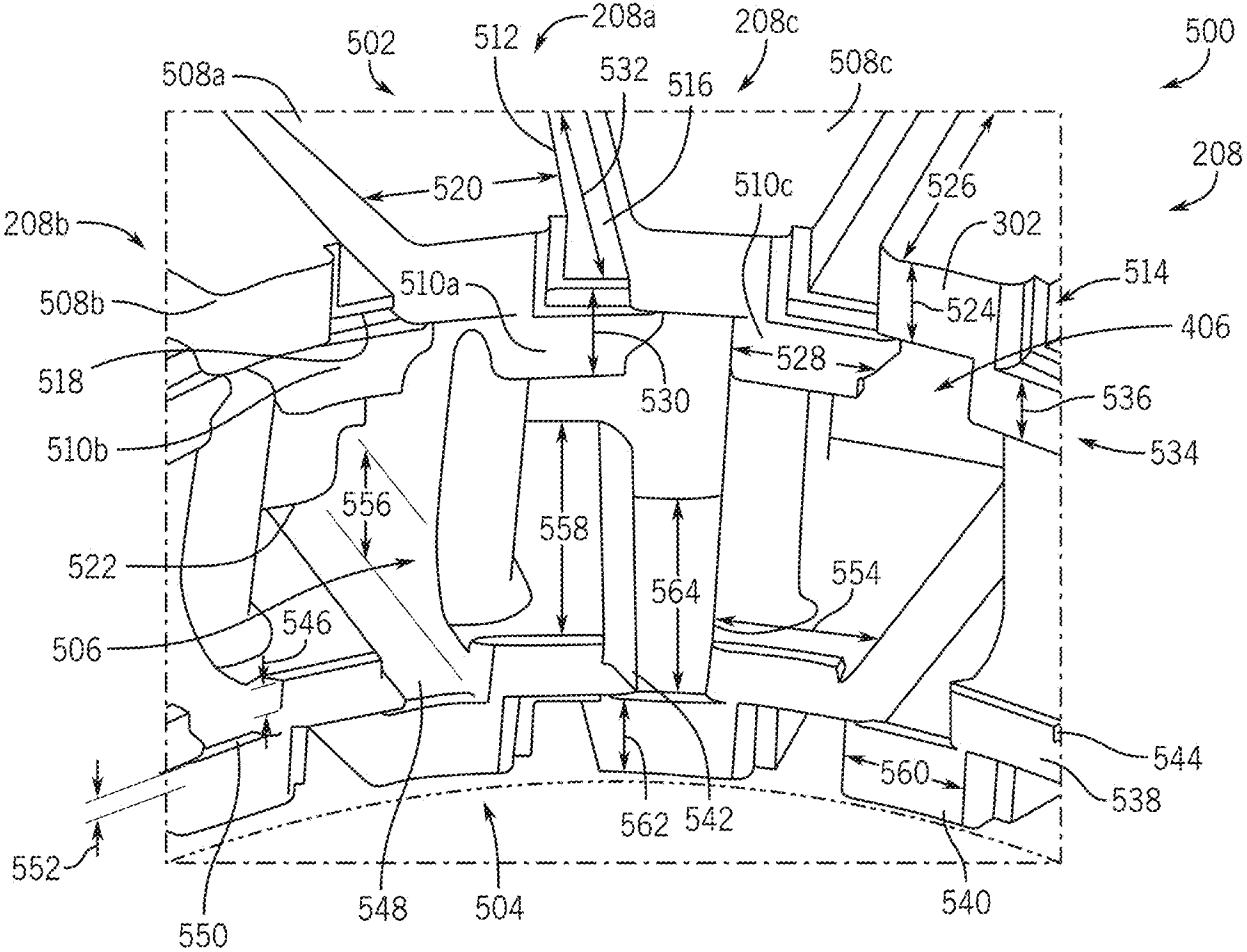
FIG. 5 is a perspective view of an embodiment of an insert arrangement, in accordance with embodiments of the present disclosure.

FIG. 5 is a detailed perspective view of an insert arrangement 500 including a plurality of inserts 208 arranged in an interlocking and/or overlapping matter that may facilitate movement and/or adjustment of the inserts with respect to one another. For clarity, certain inserts 208 may be designated with a letter, such as "A" to differential between different inserts 208 of the plurality of inserts 208. Moreover, when discussing adjacent inserts 208, a particular insert 208 is adjacent to another insert 208 when at least a portion of each insert 208 is in contact with the other insert 208.

The illustrated inserts 208 each include a top portion 502, a bottom portion 504, and a body portion 506. As shown, the body portion 506 spans between the top portion 502 and the bottom portion 504 to couple the top portion 502 to the bottom portion 504 and form the insert 208. This body portion 506, which may also be referred to as a rib or column, may provide additional rigidity and support to block flow of the packer 306. That is, as noted above, the body portion 506 may occupy at least a portion of the void 406 to reduce a flow area for the packer.

The respective top portions 502 include an upper overlapping portion 508 and an upper overlapped portion 510. As illustrated, an adjacent overlapping portion 508A is arranged axially higher to overlap an adjacent upper overlapped portion 510B. Each of the inserts 208 includes both the upper overlapping portion 508 and the upper overlapped portion 510, and as a result, each insert 208 both overlaps a portion of, and is overlapped by a portion of, respective adjacent inserts 208. By way of example, the insert 208A includes the upper overlapping portion 508A that is positioned to overlap the adjacent upper overlapped portion 510B of the insert 208B. Additionally, the insert 208A includes the upper overlapped portion 510A that is positioned to be overlapped by the adjacent upper overlapping portion 510C of the insert 208C. This may also be referred to as a shoulder/ceiling configuration where a portion of each insert 208 acts as a ceiling (508) to a component of an adjacent insert 208 and also rests on a shoulder (510) formed by an adjacent insert 208. Such an arrangement by block axial movement of the inserts 208 because adjacent inserts will block upward and downward movement. However, it should be appreciated that the arrangement within the body 402, among other factors, may also block or hinder movement of respective inserts 208 in a variety of directions.

Each top portion 502 includes a step 512 between the upper overlapping portion 508 and the upper overlapped portion 510 illustrative of an elevational change (e.g., change in axial height). Furthermore, along this step 512, is a cutout or recessed area 514 along the face 302 of the insert 208. At least a portion of the cutout 514 is arranged at a lower axial height than a platform 516 formed by the step 512. Additionally, the cutout 514 also includes a cutout face 518 that is radially retracted with respect to the face 302 (as viewed from the axis 210). That is, the cutout face 518 is radially farther from the axis 210. As will be described, the cutout 514 may form a region to enable interaction with lip formed on a mating component, such as a mating upper overlapping portion 508. In various embodiments, the lip extends into the void 406, at least partially, and rests on the cutout 514, at least partially.

The illustrated upper overlapping portion 508 is generally wedge-shaped (e.g., triangular with a tip cut off) and has variable circumferential length 520 from the face 302 to a rear 522 (which is illustrated with respect to the bottom portion 504). Moreover, the upper overlapping portion 508 has an axial height 524 and a radial depth 526. In various embodiments, these dimensions may be particularly selected based on anticipated operating conditions. It should be appreciated that the upper overlapped portion 510 similarly has a wedge-shape and includes a variable circumferential length 528 from the face 302 to the rear 522, along with an axial height 530 and a radial depth 532. In various embodiments, the dimensions for the upper overlapping portion 508 and the upper overlapped portion 510 are substantially similar. However, it should be appreciated that they may be different and dimensions may be selected based on anticipated operating conditions, among other options.

In operation, the upper overlapping portion 508A is positioned on the upper overlapped portion 510B such that at least a portion of the upper overlapping portion 508A is arranged within the cutout 514B, which may extend for at least a portion of the radial depth 532B. However, it should be appreciated that in other embodiments, at least a portion of the upper overlapping portion 508A may be arranged along the platform 516B. For example, in embodiments, the cutout 514B may not extend the entire radial depth 532B. That is, a lip (described below) may be arranged within the cutout 514B while a substantially planar lower surface is arranged along the platform 516.

Further illustrated with respect to the top portion 502 is a hanging lip 534 extending axially downward from the upper overlapped portion 510 for a hanging lip height 536. The hanging lip 534 may extend for the circumferential length 528, but in embodiments, may be shorter than or longer than the circumferential length 528. For example, in the illustrated embodiment, the hanging lip 534 corresponds to the cutout 514. In other words, dimensions of the hanging lip 534 are selected to correspond to the cutout 514. As will be described, the hanging lip 534 may block flow of the elastomer during operation.

Turning to the bottom portion 504, a lower overlapping portion 538 and lower overlapped portion 540 are illustrated at different axial heights, with the lower overlapping portion being axially higher than the lower overlapped portion 540. The lower overlapping portion 538 includes a sloped edge 542 that may be shaped to mate with an edge associated with the lower overlapped portion 540. In various embodiments, the edges may mate when the insert arrangement 500 is compressed to its smallest size.

The face 302 of the lower overlapping portion 538 includes a lip 544 (e.g., a first lip) that extends axially upward for a lip height 546. The lip 544 may be utilized to block or otherwise prevent flow of the packer during operation in a similar manner to the hanging lip 534.

The lower overlapping portion 538 is arranged along a platform 548 formed by the lower overlapped portion 540. In various embodiments, the platform 548 is substantially flat, but it should be appreciated that the platform 548 may include elevational changes or the like. Moreover, the face 302 of the lower overlapped portion 540 includes a second lip 550 extending a second lip height 552. As noted above, the second lip 550 may block flow of the elastomer during operations. In various embodiments, the first lip height 546 is equal to the second lip height 552. However, it should be appreciated that the first lip height 546 may be greater than or equal to the second lip height 552. Furthermore, different inserts 208 may have different lip heights 546, 552.

The illustrated lower overlapping portion 538 is generally wedge-shaped (e.g., triangular with a tip cut off) and has variable circumferential length 554 from the face 302 to the rear 522. Moreover, the lower overlapping portion 540 has an axial height 556 and a radial depth 558. In various embodiments, these dimensions may be particularly selected based on anticipated operating conditions. It should be appreciated that the lower overlapped portion 540 similarly has a wedge-shape and includes a variable circumferential length 560 from the face 302 to the rear 522, along with an axial height 562 and a radial depth 564. In various embodiments, the dimensions for the lower overlapping portion 538 and the lower overlapped portion 540 are substantially similar. However, it should be appreciated that they may be different and dimensions may be selected based on anticipated operating conditions, among other options.

In operation the lower overlapping portion 538 is driven to move along the lower overlapped portion 540 to increase or decrease the sealing diameter. In various embodiments, a range of travel may be blocked or otherwise restricted. For example, radial movement may be blocked by the second lip 550 to prevent internal radial movement. Furthermore, in embodiments contact between adjacent portions, such as the sloped edge 542 contacting the lower overlapping portion 538, may block further movement.

Figure 6:
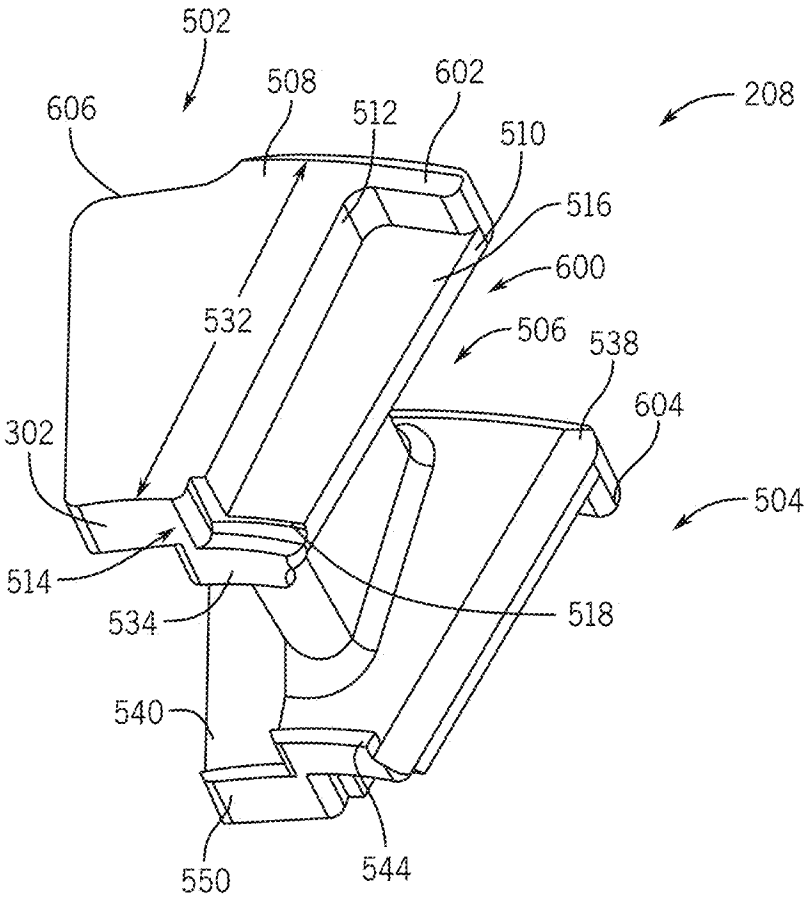
FIG. 6 is a perspective view of an embodiment of an insert, in accordance with embodiments of the present disclosure.

FIG. 6 is a perspective view of an embodiment of the insert 208. As described above, the insert 208 includes the top portion 502 coupled to the bottom portion 506 via the body portion 504. Each of the top and bottom portions 502, 504 include respective overlapping portions 508, 538 and overlapped portions 510, 540 where adjacent inserts 208 may interact with one another.

The top portion 502 includes the step 512 between the upper overlapping portion 508 and the lower overlapping portion 510 to form the platform 516. As illustrated in FIG. 6, the platform 516 of this embodiment does not extend for the entire radial depth 532, but rather, forms a pocket 600 to receive an adjacent upper overlapping portion 508. The pocket 600 includes a rear wall 602, which blocks further outer radial movement of the adjacent upper overlapping portion 508. Furthermore, in this embodiment, the cutout 514 is arranged at the face 302 to form the cut out face 518, but does not extend along the pocket 600. However, in various embodiments, the hanging lip 534 may be sized to approximately fit within the cutout 514 of an adjacent insert 208, thereby enabling full overlap between the respective overlapping and overlapped portions.

The illustrated lip 544 and second lip 550 are further illustrated with respect to the bottom portion 504. Each of these lips may be utilized to block or distort an extrusion path of the elastomer, thereby maintaining integrity even in operating ranges that may be beyond ideal or intended conditions for the elastomer.

As noted above, the upper overlapped portion 510 includes the rear wall 602. Further illustrated is a similar lower rear wall 604 with respect to the lower overlapping portion 538. Each of these walls 602, 604 may be shaped to engage a groove 706 formed in an adjacent insert 208. That is, a profile of the rear wall 602 may be substantially similar to a profile of the groove 706. For example, the illustrated groove 706 is formed in the upper overlapping portion 508. As a result, when the upper overlapping portion 508 fully engages an adjacent upper overlapped portion 508, the upper overlapping portion 508 may fit within the pocket 600. While obscured in FIG. 6, a similar groove 706 may also be formed with respect to the lower overlapped portion 540.

It should be appreciated that FIG. 6 includes edges with various bevels and bends, which may be particularly selected based on anticipated operating conditions and the like. Accordingly, the inclusion of a beveled edge is shown as an example, much like the inclusion of a straight edge is shown only as an example.

Figure 7:
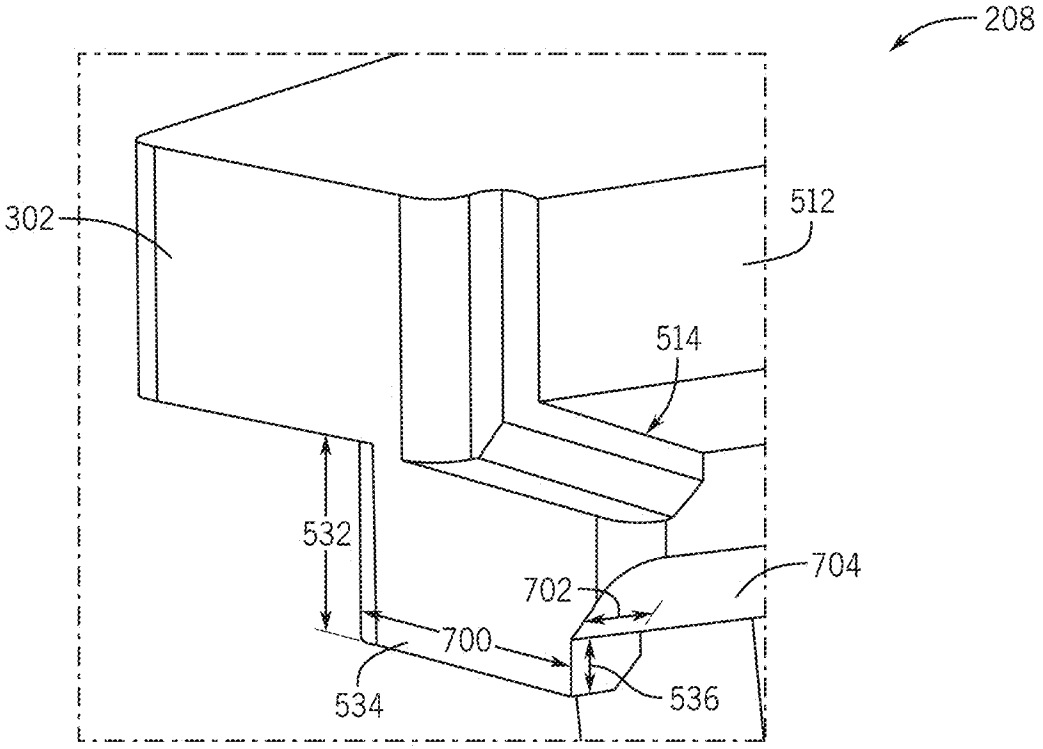
FIG. 7 is a perspective view of an embodiment of an insert, in accordance with embodiments of the present disclosure.

FIG. 7 is a detailed perspective view of an embodiment of the insert 208. FIG. 7 includes specific reference to the face 302 to illustrate the cutout 514 and the hanging lip 534. As shown, the hanging lip 534 extends the lip height 536, which as noted above, may correspond to a cutout formed in an adjacent insert 208. The illustrated cutout 514 is an L-shape extending along the step 512 and removing portions of both the upper overlapping portion 508 and the lower overlapped portion 510. The illustrated cutout 514 includes beveled edges, but as noted above, such bevels are for illustrative purposes only and, in various embodiments, may be straight, curved, or the like.

As shown, the hanging lip 534 extends for a hanging lip circumferential distance 700, which as noted above, is less than the circumferential length 528. However, it should be appreciated that the hanging lip circumferential distance 700 may be equal to the circumferential length 528 or less than the circumferential length 528. Additionally, the hanging lip radial depth 702 is illustrated as being less than the radial depth 532. As noted, dimensions may be particularly selected to account for operating conditions and the like.

The upper overlapped portion 510 includes a sloped lower surface 704, which may be formed to contact or otherwise engage one or more portions of an adjacent insert 208. Furthermore, the sloped shape may be particularly selected to control flow and extrusion paths for the packer. However, it should be appreciated that other shapes may be utilized and that various different configurations may be utilized for a variety of reasons, such as to control stiffness, reduce material use, reduce weight, and the like.

Figure 8:
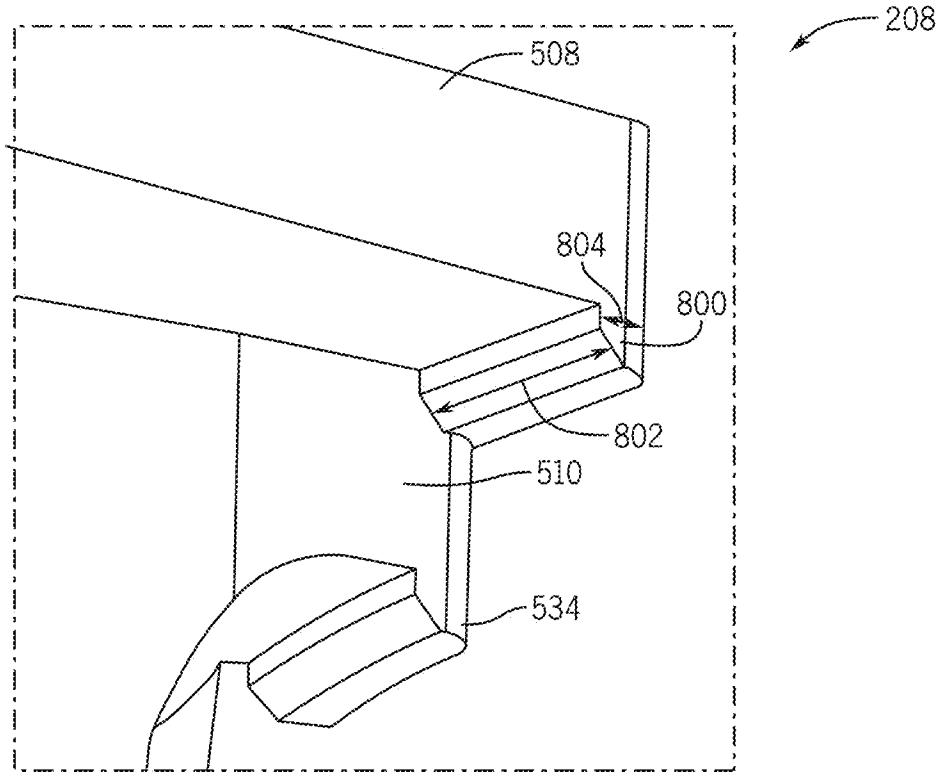
FIG. 8 is a perspective view of an embodiment of an insert, in accordance with embodiments of the present disclosure.

FIG. 8 is a detailed perspective view of the insert 208 illustrating a rear view slowing both the hanging lip 534 and a second hanging lip 800 extending from the upper overlapping portion 508. The second hanging lip 800 includes a hanging lip circumferential distance 802 that is less than the circumferential length 520, however, as noted above, in various embodiments certain proportions and dimensions may be adjusted based on anticipated operating conditions. The second hanging lip 800 further has a hanging lip radial depth 804. In various embodiments, the lip radial depth 804 corresponds to a size of the adjacent cutout 514 to facilitate interaction between the components.

As noted herein, in various embodiments, the insert 208 may be formed from a metallic material and/or a composite material and, in various embodiments, may be formed using an additive manufacturing process. As a result, different configurations may be generated for anticipated operating conditions without expensive retooling costs.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

The invention claimed is:

1. An insert for a variable bore ram block, comprising:

a top portion, comprising:

an upper overlapping portion having a first lip extending in an axially downward direction;

an upper overlapped portion having a second lip extending in the axially downward direction; and a first step between the upper overlapping portion and the upper overlapped portion, the step having a first axial height change between the upper overlapping portion and the upper overlapped portion;

a bottom portion, comprising:

a lower overlapping portion having a third lip extending in an axially upward direction;

a lower overlapped portion having a fourth lip extending in the axially upward direction; and a second step between the lower overlapping portion and the lower overlapped portion, the second step having a second axial height change between the lower overlapping portion and the lower overlapped portion; and a body portion between the top portion and the bottom portion, the body portion connecting the top portion to the bottom portion;

wherein the upper overlapped portion comprises a platform formed by a pocket, the pocket at least partially defined by a rear wall and the upper overlapping portion comprises a groove, the groove having a profile corresponding to a profile of the rear wall.

2. The insert of claim 1, wherein at least a portion of the first lip and a portion of the fourth lip are, at least partially, arranged on a first side of the body portion and at least a portion of the second lip and a portion of the third lip are, at least partially, arranged on a second side of the body portion.

3. The insert of claim 1, wherein each of the first lip, the second lip, the third lip, and the fourth lip extend into a void formed between the top portion and the bottom portion, the void forming a flow path for a packer associated with the insert.

4. The insert of claim 1, wherein the upper overlapped portion comprises a cutout formed at a face, the cutout being radially recessed from the face.

5. The insert of claim 1, wherein a circumferential length of at least one of the upper overlapping portion, the upper overlapped portion, the lower overlapping portion, or the lower overlapped portion is variable between a face and a rear.

* * * * *